US006592475B2

(12) United States Patent
Poggi et al.

(10) Patent No.: US 6,592,475 B2
(45) Date of Patent: Jul. 15, 2003

(54) SPORTS RACKET HAVING A TUBULAR FRAME WITH REINFORCING ELEMENT

(75) Inventors: Marc Poggi, Lyons (FR); Yann Bernard, Lyons (FR); Yvan Le Bozec, Lyons (FR)

(73) Assignee: Babolat VS, Lyons (FR)

( * ) Notice: Subject to any disclaimer, the term of this patent is extended or adjusted under 35 U.S.C. 154(b) by 0 days.

(21) Appl. No.: 09/977,968

(22) Filed: Oct. 17, 2001

(65) Prior Publication Data

US 2002/0052256 A1 May 2, 2002

(30) Foreign Application Priority Data

Oct. 17, 2000 (FR) ..... 00 13296

(51) Int. Cl.[7] ..... A63B 49/02
(52) U.S. Cl. ..... 473/524; 473/535; 473/546
(58) Field of Search ..... 473/546, 524, 473/535, 536, 544, 545, 547, 520, 521, 537

(56) References Cited

U.S. PATENT DOCUMENTS

| | | | | | |
|---|---|---|---|---|---|
| 4,031,181 | A | | 6/1977 | Schaefer | |
| 4,983,242 | A | * | 1/1991 | Reed | 156/172 |
| 5,131,651 | A | * | 7/1992 | You | 473/318 |
| 5,220,719 | A | * | 6/1993 | You | 264/254 |
| 5,368,298 | A | * | 11/1994 | You | 473/536 |
| 6,012,996 | A | * | 1/2000 | Lo | 473/546 |
| 2002/0052256 | A1 | * | 5/2002 | Poggi et al. | 473/546 |

FOREIGN PATENT DOCUMENTS

DE 3541590 3/1987

* cited by examiner

*Primary Examiner*—Raleigh W. Chiu
(74) *Attorney, Agent, or Firm*—Dowell & Dowell, P.C.

(57) ABSTRACT

A sports racket frame including a main body which has an intermediate portion in the vicinity of which is provided at least one reinforcing member which defines, with the intermediate portion, an inner volume therebetween which extends about an outer periphery of the intermediate portion.

17 Claims, 3 Drawing Sheets

SPORTS RACKET HAVING A TUBULAR FRAME WITH REINFORCING ELEMENT

BACKGROUND OF THE INVENTION

1. Field of the Invention

The present invention relates to a racket frame, a racket provided with such a frame, as well as to a set of a plurality of these frames.

The invention relates more particularly to a racket provided with a head, such as a tennis, badminton or squash racket.

2. Description of the Related Art

U.S. Pat. No. 6,012,996 discloses such a racket which comprises a frame made of a fiber-reinforced plastics material. This frame, which is composed of a head, a handle and a throat located between the head and the handle, presents an oval main body, formed by two inner tubes and an outer tube.

According to the teaching of this document, the two inner tubes are disposed side by side, with the result that their adjoining walls form a cross rib, intended to reinforce the frame, while the presence of the outer tube makes it possible to reduce the stresses likely to be produced at the level of this rib.

It is an object of the present invention to make a racket frame constituting an alternative to the prior art set forth hereinabove.

SUMMARY OF THE INVENTION

To that end, it relates to a racket frame, particularly for tennis, squash or badminton, comprising a tubular body, characterized in that the tubular body has at least one intermediate portion in the vicinity of which are provided reinforcing means, these reinforcing means defining, with this intermediate portion, an inner volume extending over the whole outer periphery of the intermediate portion.

The invention also has for an object a racket, particularly for tennis, squash or badminton, comprising a frame presenting a head, as well as strings stretched within and around this head, characterized in that this frame is as defined hereinabove.

Finally, the invention has for its object a set of frames, comprising a plurality of types of frames as defined hereinabove.

BRIEF DESCRIPTION OF THE DRAWINGS

The invention will be more readily understood on reading the following description given by way of non-limiting examples, with reference to the accompanying drawings, in which.

DESCRIPTION OF THE PREFERRED EMBODIMENTS

Figure 1:
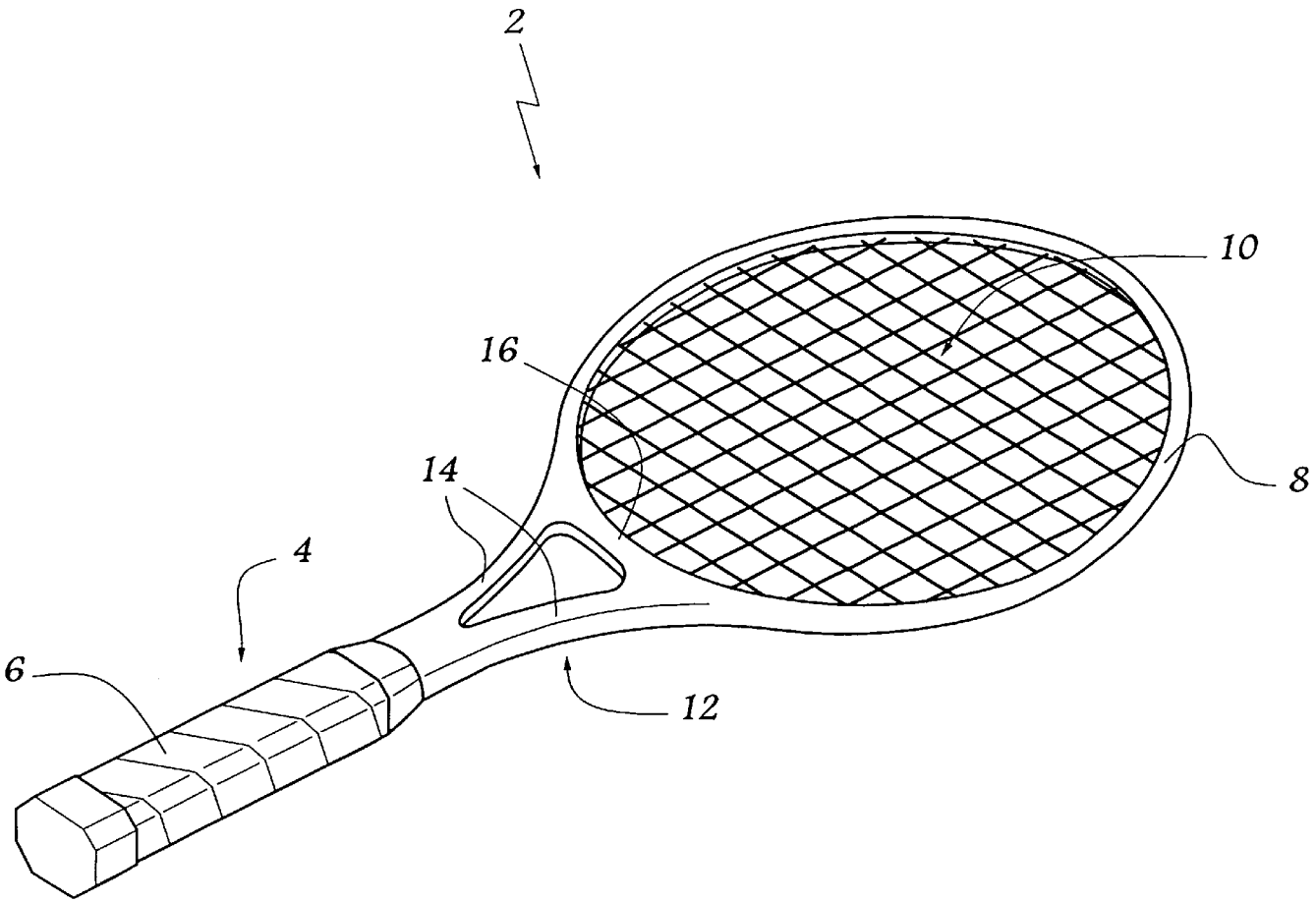
FIG. 1 is a view in perspective of a racket according to the invention.

Referring now to the drawings, the racket illustrated in FIG. 1, which is generally designated by reference 2, comprises a handle 4 around which a covering tape 6, also called a "grip", is wound. The handle is extended by a head 8, of oval shape, within which strings 10 are stretched. The region between the handle and the head, called the throat 12, includes divergent branches 14, joined by a bridge 16 at their end opposite the handle 4.

Figure 2:
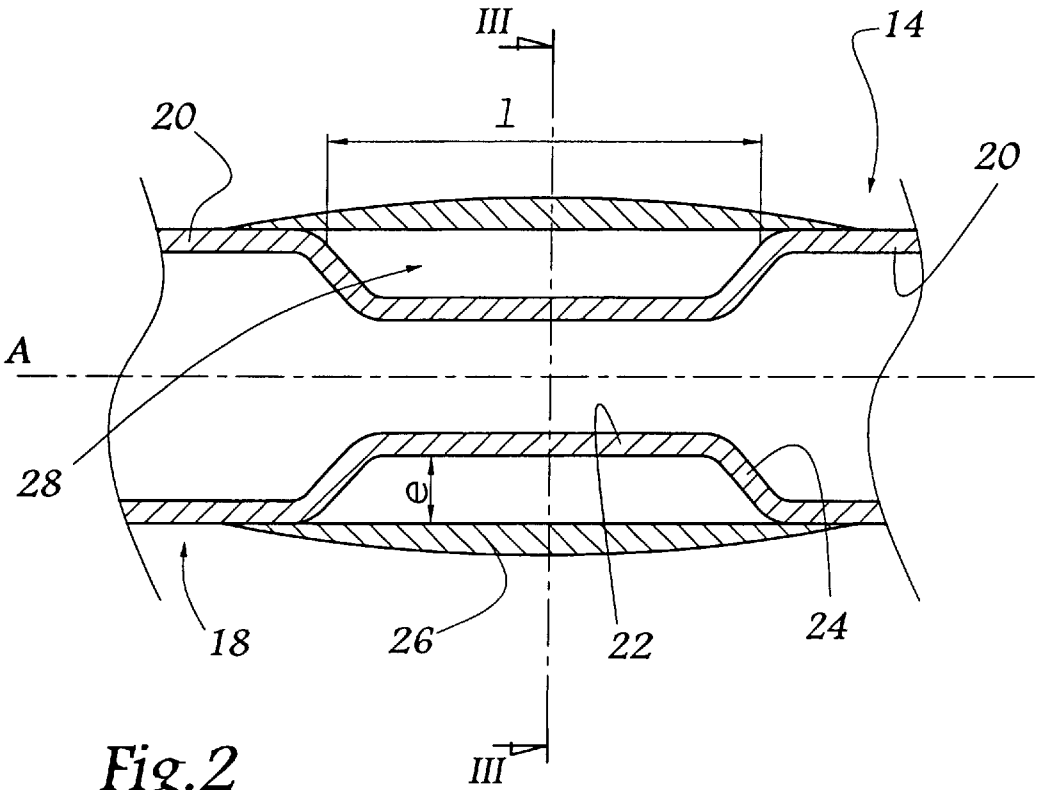
FIG. 2 is a view in longitudinal section, partially illustrating the frame of the racket of FIG. 1.

The handle 4, the head 8 and the throat 12, which form the frame of the racket, comprise a rigid tubular body 18 illustrated in particular in FIG. 2, which is for example made of aluminium or more advantageously of composite material. This tubular body may for example be manufactured from carbon fibers which may also be mixed with other types of fibers, such as glass fibers, all these fibers being bonded in a matrix which may be a thermosetting or thermoplastic resin. An epoxide resin matrix, for example, may advantageously be used.

This tubular body 18 comprises a main portion 20 of substantially constant section, as well as an intermediate portion 22, forming a neck. This latter, which is coaxial to the main portion 20, presents a transverse dimension less than said main portion and is joined thereto via two peripheral shoulders 24.

In the example described and shown, this intermediate portion 22 is present on one of the branches 14 of the throat 12. In a variant, it may equip another region of the frame. It may also be envisaged to provide a plurality of similar intermediate portions.

As shown in FIG. 2, a reinforcing element 26, of tubular shape, covers the intermediate portion 22. To that end, this element 26 extends between those regions of the main portion 20 adjacent the shoulders 24.

This element 26 is made for example of metal, plastics material or, preferably, composite material. Furthermore, it is coaxial to the main portion 20, as well as to the intermediate portion 22. It is rigidly fixed on the aforementioned regions of the main portion 20.

This means that there is essentially no degree of freedom between the main portion 20 and the reinforcing element 26, in particular along the principal axis A of the tubular body 18. Such a fixation, which corresponds to a complete bond between the main portion and the reinforcing element, is effected, for example, by intimate bond of these latter during moulding thereof, or by adhesion, particularly in the case of aluminium being used.

The inner wall of the reinforcing element 26 thus forms, with the opposite outer wall of the intermediate portion 22, an inner volume 28 of annular shape, extending over the whole of the periphery of this intermediate portion 22. This volume 28 has a longitudinal dimension, or length "L", included for example between 2 and 10 cm, and a transverse dimension, or thickness "e", included for example between 0.5 and 5 mm. The volume is filled with a gas, which may, in particular, be air.

Figure 4:
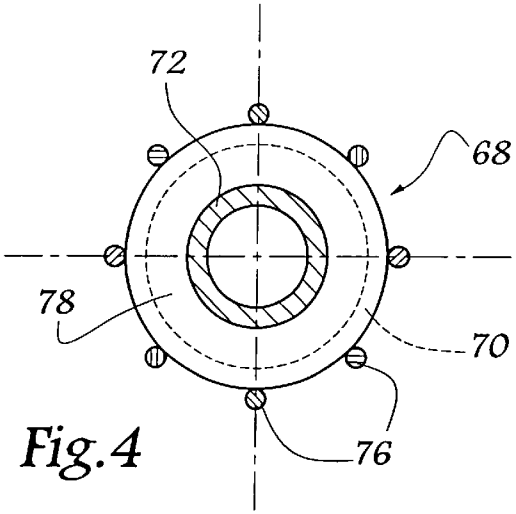

FIG. 4 illustrates a first variant embodiment of the invention, in which the mechanical elements similar to those of FIGS. 1 and 2 are attributed the same reference numbers, increased by 50. According to this variant, the tubular element 26 is replaced by a plurality of rods 76 which extend over the periphery of the intermediate portion 72.

Figure 5:
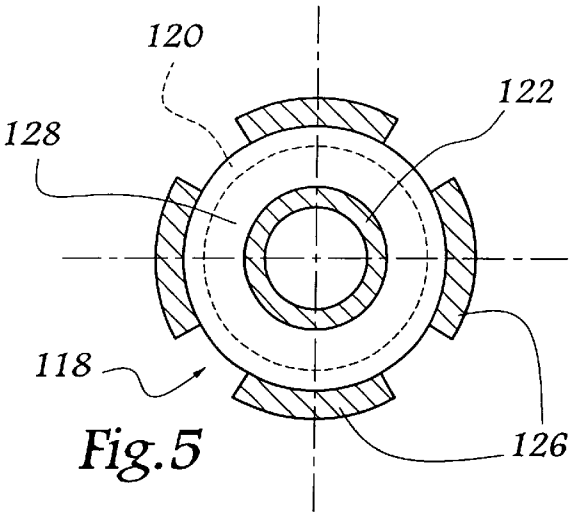
FIGS. 4 and 5 are views in transverse section, similar to FIG. 3, illustrating two variant embodiments of the invention.

FIG. 5 illustrates a second variant embodiment of the invention in which the mechanical elements similar to those of FIGS. 1 and 2 are attributed the same reference numbers, increased by 100. According to this second variant, the tubular element 26 is replaced by a plurality of bands 126 forming arcs of circle, which extend over the outer periphery of the intermediate portion 122.

Figure 6:
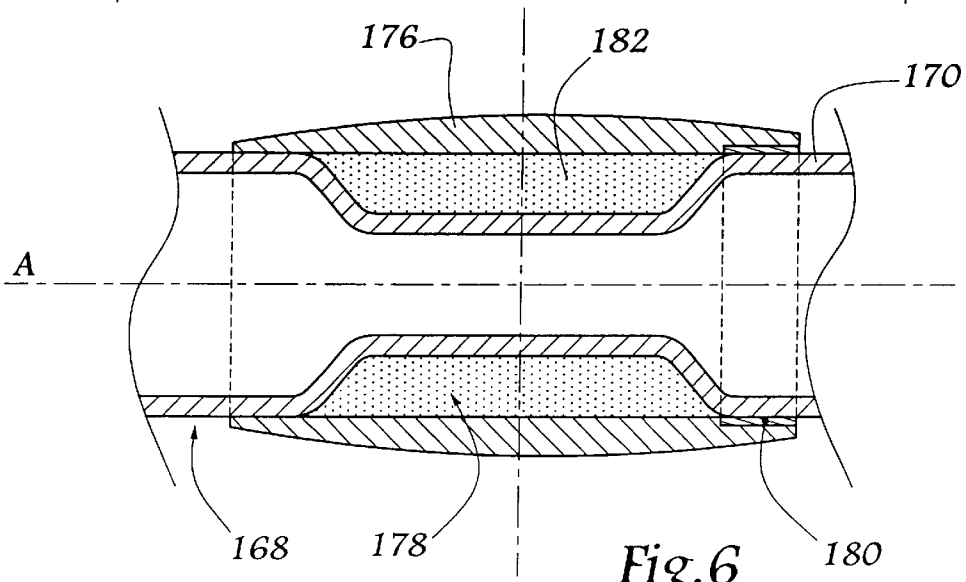
FIG. 6 is a view in longitudinal section, similar to FIG. 2, illustrating a third variant of the invention.

FIG. 6 illustrates a third variant of the invention, in which the mechanical elements similar to those of FIGS. 1 and 2 are attributed the same reference numbers, increased by 150.

According to this third variant, the reinforcing element 176 is rigidly fixed, at only one of its ends, on the main portion 170. On the other hand, it is connected to the latter, at its other end, with the interposition of a deformable ring 180.

The latter allows a degree of freedom, along the principal axis A, between the main portion 170 and the reinforcing element 176. This ring may for example be glued both to this portion 170 and to this element 176, with the result that it is subject to a certain shear during their mutual displacement along axis A. In a variant, this ring need not be glued, but simply interposed between the portion 170 and the reinforcing element 176, with the result that it is able to rub along the latter during their mutual displacement.

Furthermore, the volume 178 is filled with a foam 182 which is for example of the EVA (ethylene-vinyl-acetate) type. In a variant, such a foam may be replaced by any other material which does not substantially influence the mechanical behaviour of the whole of the racket. Such material may, inter alia, be a gel.

The volume, whether it be filled with a gas or a solid material, is neutral with respect to the mechanical behaviour of the racket, insofar as it does not constitute a structural element thereof. In fact, it forms a bifurcation between the intermediate portion of the main body and the reinforcing means, and contributes to separating them mechanically. This volume does not act against the functioning of the racket, particularly concerning flexion and shear.

Figure 3:
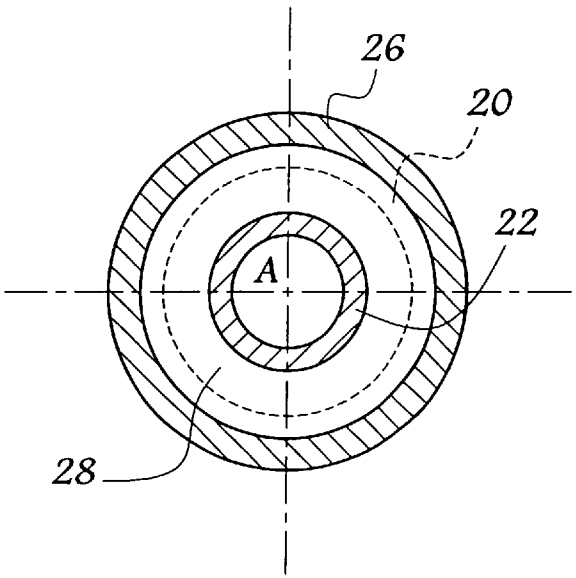
FIG. 3 is a view in transverse section along line III—III of FIG. 2.

In all of the examples described and shown, mention has been made of an intermediate portion, whose transverse dimension is smaller than the main portion of the tubular body. By way of variant, this intermediate portion may present a transverse dimension substantially similar to that of this main portion. In such a hypothesis, this intermediate portion is in that case surrounded by a reinforcing zone of larger diameter, which may be made in the form of a tubular element or of discrete elements, as in FIGS. 3 to 5.

It is advantageous to employ reinforcing means extending over the periphery of an intermediate portion of the tubular body, belonging to the frame of the racket. In effect, these reinforcing means make it possible to increase the rigidity of the racket according to the invention.

In addition, the possible presence of deformable means makes it possible to modulate the rigidity given to this racket. Consequently, it may be envisaged to create a range of rackets presenting various rigidities, as a function in particular of the users' needs.

What is claimed is:

1. A sports racket frame for tennis, squash or badminton, comprising, a tubular body having at least one intermediate portion, said at least one intermediate portion extending inwardly from a main portion of said tubular body and having a transverse dimension which is less than a transverse dimension of said main portion of said tubular body, reinforcing means secured at at least one end to said main portion of said tubular body and extending over and spaced from said at least one intermediate portion to thereby define an inner volume which extends about an outer periphery of said at least one intermediate portion.

2. The sports racket frame according to claim 1, wherein said inner volume has a transverse dimension (e) included between 0.5 and 5 mm.

3. The sports racket frame of claim 2 wherein said transverse dimension (e) is between 1.0 to 2.0 mm.

4. The sports racket frame according to claim 1 wherein said inner volume is filled with a gas.

5. The sports racket frame of claim 4 wherein said gas is air.

6. The sports racket frame according to claim 1 wherein said inner volume is filled with a foam.

7. The sports racket frame according to claim 1 wherein said reinforcing means includes a tubular element extending about the periphery of said at least one intermediate portion.

8. The sports racket frame according to claim 1 wherein said reinforcing means includes a plurality of discrete elements.

9. The sports racket frame of claim 8 in which said plurality of discrete elements are rods.

10. The sports racket frame of claim 8 in which said plurality of discrete elements are arcuate bands.

11. The sports racket frame according to claim 1 wherein said reinforcing means are bonded to regions of said main portion of said tubular body, located on either side of said at least one intermediate portion.

12. The sports racket frame according to claim 11 wherein said reinforcing means are rigidly connected to said regions.

13. The sports racket frame according to claim 11 wherein said reinforcing means are connected to said regions with the interposition, at least at one of the ends of said reinforcing means, of deformable means adapted to ensure at least one degree of freedom between said reinforcing means and said tubular body.

14. The sports racket frame of claim 1 including a plurality of spaced intermediate portions, and a plurality of reinforcing means extending over said plurality of spaced intermediate portions.

15. The sports racket frame of claim 14 in which each of said plurality of reinforcing means is a tubular element.

16. The sports racket frame of claim 15 including a deformable ring positioned between at least one end of each of said plurality of reinforcing means one said main portion of said tubular body.

17. The sports racket frame of claim 1 wherein said at least one intermediate portion is coaxial with respect to a central axis of said main portion of said tubular body.

* * * * *